US005930834A

United States Patent [19]

Toovey

[11] Patent Number: 5,930,834

[45] Date of Patent: Aug. 3, 1999

[54] HEADWEAR WITH RETRACTABLE SUNGLASS SHEET

[76] Inventor: Mark E. Toovey, 34 Bribie Pines Ct., Queensland 4556, Australia

[21] Appl. No.: 08/930,483

[22] PCT Filed: Mar. 22, 1995

[86] PCT No.: PCT/AU95/00160

§ 371 Date: Jul. 19, 1997

§ 102(e) Date: Jul. 19, 1997

[87] PCT Pub. No.: WO96/28986

PCT Pub. Date: Sep. 26, 1996

[51] Int. Cl.[6] ..... A42B 1/06

[52] U.S. Cl. ..... 2/10; 2/181.4; 351/155

[58] Field of Search ..... 2/10, 181, 181.2, 2/181.4, 209.13, 452, 453; 351/155, 156

[56] References Cited

U.S. PATENT DOCUMENTS

| | | | |
|---|---|---|---|
| 1,696,198 | 12/1928 | Gross . | |
| 2,500,280 | 3/1950 | Feldman . | |
| 4,179,753 | 12/1979 | Aronberg et al. | 2/10 |
| 4,869,586 | 9/1989 | Chung | 351/158 |
| 5,177,810 | 1/1993 | Minton et al. | 2/10 |
| 5,491,841 | 2/1996 | Valletta | 2/10 |
| 5,581,807 | 12/1996 | Peterson | 2/10 |

FOREIGN PATENT DOCUMENTS

| | | |
|---|---|---|
| 637.556 | 5/1928 | France . |
| 700.393 | 2/1931 | France . |
| 418658 | 9/1925 | Germany . |
| 461664 | 6/1928 | Germany . |
| 108478 | 3/1921 | Switzerland . |
| 109881 | 5/1925 | Switzerland . |
| 139164 | 6/1930 | Switzerland . |

*Primary Examiner*—Diana L. Oleksa
*Attorney, Agent, or Firm*—Klarquist Sparkman Campbell Leigh & Whinston, LLP

[57] ABSTRACT

An article of headwear is described including a hat body and a flexible head band extending about the forehead and sides of the head of a wearer, with a hat brim fixed to the hat body adjacent the head band. The hat brim has a front brim portion projecting above the eyes of the wearer. A flexible transparent sunglass sheet is secured directly to the head band by a connection which is adapted to move the sunglass sheet between only two positions including an extended position with the sunglass sheet extending downward from the hat brim, and a retracted position with the sunglass sheet extending upward from the hat brim. The sunglass sheet has downward curved upper edge portions at each side which are attached to the head band. Also, the sunglass sheet has a resilient nose-contact member attached to the lower edge of a nose-bridging portion of such sheet. In addition, the sunglass sheet may have resilient cheek-contact members fitted to the lower edges of two eyeglass-shaped portions of such sheet.

17 Claims, 2 Drawing Sheets

HEADWEAR WITH RETRACTABLE SUNGLASS SHEET

TECHNICAL FIELD OF THE INVENTION

THIS INVENTION relates to headwear, and it has more particular reference to articles of headwear fitted with sunglass means for eye protection purposes.

BACKGROUND ART

For sporting and recreational activities in particular, it is customary to wear a hat or cap over the scalp in conjunction with normal types of tinted sunglasses separately located on the ears and nose with a "lens blade" disposed in front of the eyes so that sunlight will be diffused for glare-reduction purposes. Various attempts have been made to provide hats and caps having permanently affixed sunglass means, but these have to date suffered from one disadvantage or another, including the fact that the sunglass means has always been a permanently visible part of the hat or cap even when conditions do not make the use of the sunglass means warranted.

The present invention has accordingly been devised to overcome the problems associated to date with headwear fitted with or requiring separate sunglass means for eye protection purposes, and it has for its principal object to provide a novel article of headwear combining therewith a sunglass sheet or lens which is adapted to be retracted into the headwear and thus not readily visible, if at all, when the sunglass benefits are not required. Other objects of the invention are to provide a combination of cap, hat or other article of headwear with a sunglass sheet, as aforedescribed, which will be efficient and durable, yet relatively inexpensive.

DISCLOSURE OF THE INVENTION

With the foregoing and other objects in view the invention resides broadly, according to one aspect thereof, in an article of headwear of the type including a hat body adapted to be fitted over the scalp of a wearer and having a flexible head band to engage about the forehead of the wearer, there being an affixed brim adjacent the head band and having a front brim portion projecting forwardly in use in front of and above the wearer's eyes; characterised in that:

(1) there is secured to the head band beneath said front brim portion a flexible tinted sunglass sheet adapted to be arranged in operative disposition substantially upright and arcuately around the front of the head band in front of the wearer's eyes when the hat body is fitted over the wearer's scalp, and (2) the tinted sunglass sheet is so shaped and so secured at its upper edge to the flexible head band that upon removal of the hat body, the sunglass sheet and head band may be flexed to permit the sunglass sheet to be moved flexibly in the rearwards direction from said operative disposition to a stored inoperative disposition within the hat body in which the sunglass sheet will extend upwards from the head band and be held adjacent the scalp when the hat body is re-fitted to the wearer.

Preferably, the flexible tinted sunglass sheet is made from sheet material of uniform thickness, being of elongated form and symmetrical to each side of a middle nose-bridging portion. Preferably too, the flexible tinted sunglass sheet has downwardly curved upper edge portions at each side extremity for head band attachment purposes, while it has eyeglass-shaped portions with curved lower edges at each side of the nose-bridging portion. In one embodiment, the flexible tinted sunglass sheet has resilient cheek-contact members fitted to the lower edges of both eyeglass-shaped portions. The flexible tinted sunglass sheet may also have a resilient nose-contact member fitted to the lower edge of the nose-bridging portion, the resilient contact members preferably being made of foam rubber.

According to the invention, the flexible tinted sunglass sheet is preferably formed by cutting same from a sheet of polycarbonate material, the sunglass sheet suitably having a thickness between 0.25 mm and 0.5 mm. For best practical purposes, the flexible tinted sunglass sheet is suitably affixed to the head band by sewing its upper edge to the exposed face or edge of the head band.

The article of headwear may itself be a hat, cap or partial cap, with the head band being discontinued at the rear to be replaced by adjustable connecting straps for example. Also the brim may be of continuous annular form in the case of a hat, or it can be provided at the front only in the case of a cap. In the latter case, the hat body may be in the form of a cup-like baseball-type cap body having a front stiffened but flexible brim constituting the front brim portion as aforementioned. Other features of the invention will be hereinafter apparent.

BRIEF DESCRIPTION OF THE DRAWINGS

In order that the invention may be more readily understood and put into practical effect, one suitable embodiment thereof, given by way of illustrative example only, will now be described with reference to the accompanying drawings, wherein.

Figure 4:
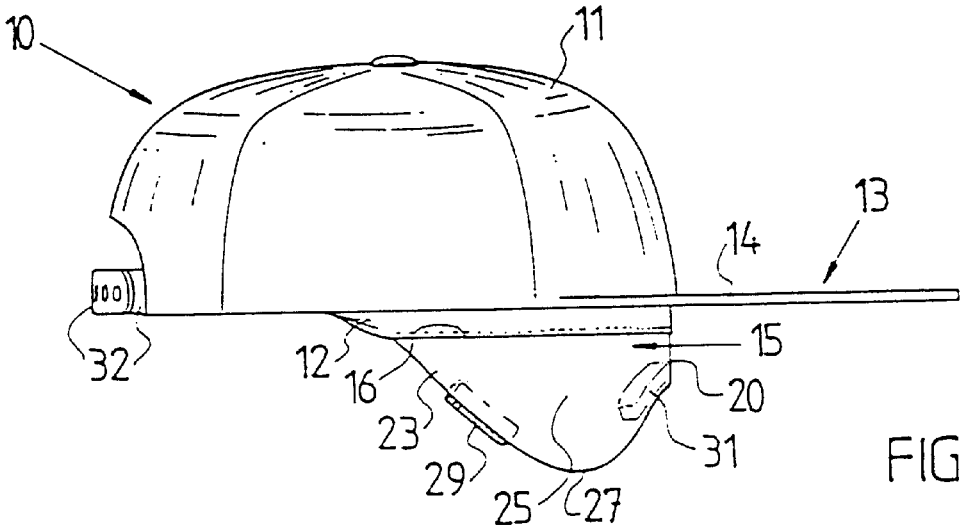
FIG. 4 is a side elevation of the cap and sunglass sheet, in the same relationship as is shown in perspective view in FIG. 2.
Figure 5:
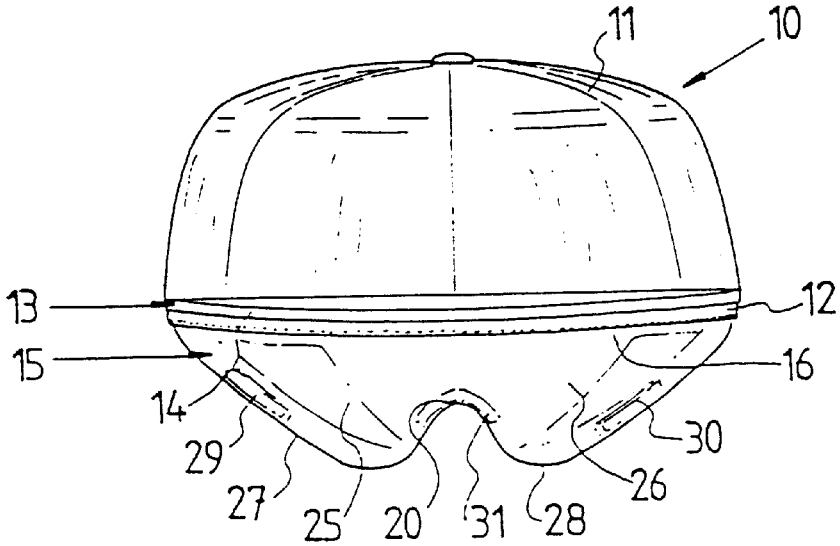
FIG. 5 is a front elevation corresponding to the side elevation of FIG. 4.

As shown in the drawings, the article of headwear 10 is of the type which includes a hat body 11 adapted to be fitted over the scalp of the wearer and having a flexible head band 12 to engage about the forehead of the wearer. It will be seen that there is an affixed brim 13 adjacent the head band 12 and having a front brim portion 14 which projects forwardly in use in front of and above the wearer's eyes. According to the invention, there is secured to the head band 12 beneath the front brim portion 14 a flexible tinted sunglass sheet 15 adapted to be arranged in operative disposition as shown in FIGS. 2, 4 and 5 to be substantially upright and extend arcuately around the front portion of the head band 12 in front of the wearer's eyes when the hat body 11 is fitted over the wearer's scalp when in the disposition of FIGS. 2, 4 and 5.

Figure 1:
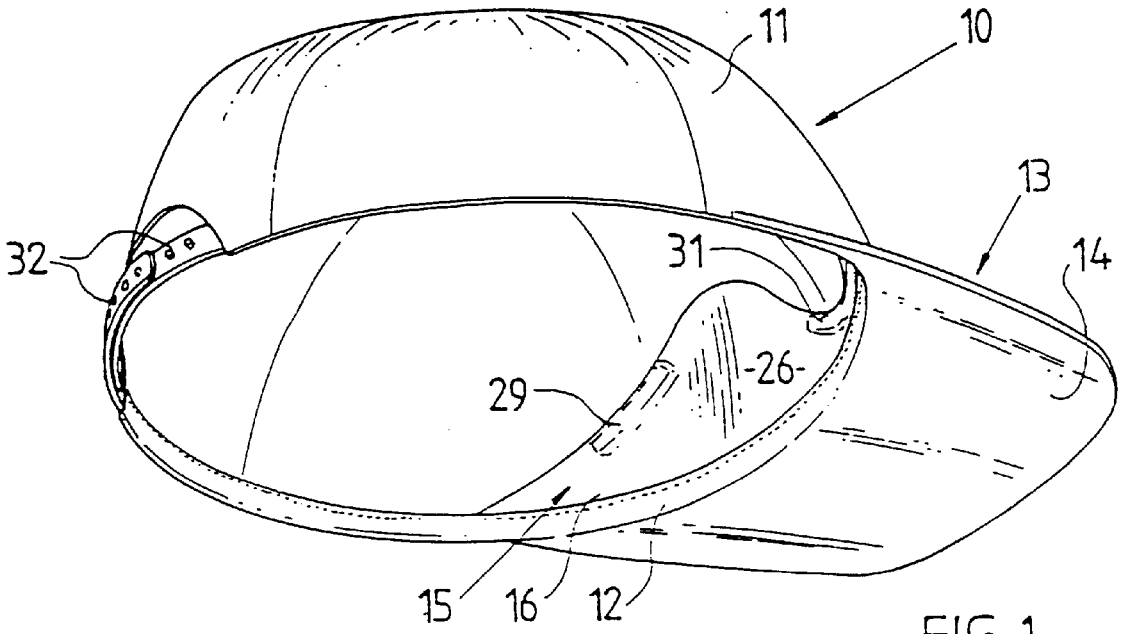
FIG. 1 shows in perspective view, from beneath, a typical baseball cap fitted with a tinted sunglass sheet according to the invention, the sunglass sheet being shown in inoperative, stored disposition.
Figure 2:
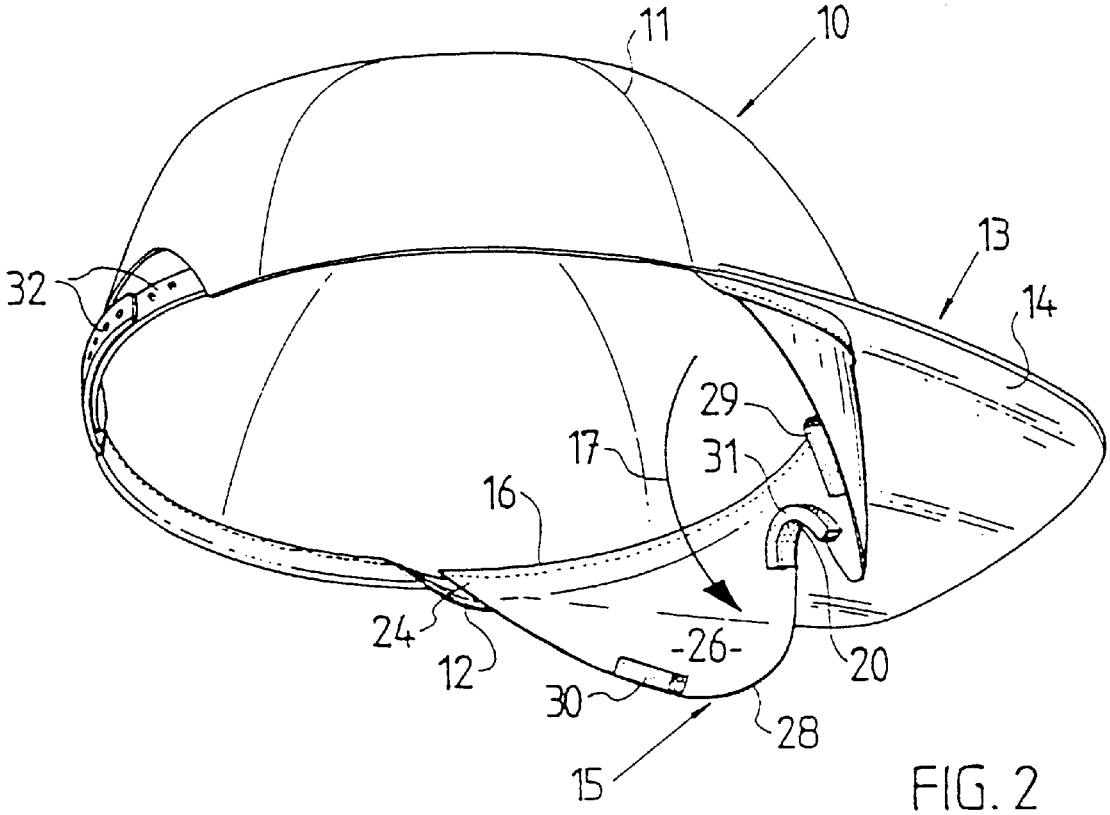
FIG. 2 is another perspective view of the baseball cap, similar to FIG. 1 but showing the sunglass sheet in operative disposition.

It will be seen that the tinted sunglass sheet 15 is so shaped and so secured at its upper edge 16 to the flexible head band 12 that upon removal of the hat body 11 from the head, the sunglass sheet 15 and head band 12 may be flexed to permit the sunglass sheet 15 to be moved flexibly in the rearwards direction, opposite to the direction of arrow 17 of FIG. 2 from the operative disposition to a stored inoperative disposition within the hat body 11 as shown in FIG. 1 with the sunglass sheet 15 extending upwards from the head band 12 and being able to be held adjacent the scalp when the hat body 11 is re-fitted to the wearer.

Figure 3:
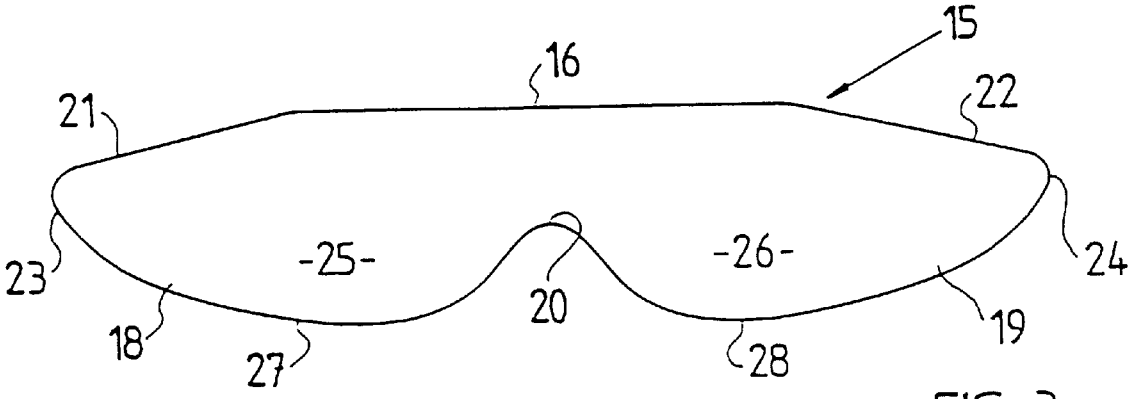
FIG. 3 shows the outline of the shaped sunglass sheet, viewed from the front, as in FIGS. 1 and 2 but prior to being fitted to the cap.

In this instance, the flexible sunglass sheet 15 is made from a sheet of material of uniform thickness, being of elongated form as shown in front view in FIG. 3 and symmetrical to each side 18 and 19 of the middle nose-bridging portion 20. As shown in FIG. 3, the sunglass sheet 15 has downwardly curved upper edge portions 21,22 at each side extremity 23,24 for head band attachment purposes, while it has eyeglass-shaped portions 25,26 with curved lower edges 27,28 at each side of the nose-bridging portion 20.

In the illustrated embodiment, the flexible tinted sunglass sheet 15 has resilient cheek-contact members 29,30 fitted to the lower edges 27,28 of both eyeglass-shaped portions 25,26, while there is also a resilient nose-contact member 31 fitted to the lower edge of the nose-bridging portion 20. Suitably the resilient contact members 29,30 and 31 are made of foam rubber.

Any suitable material may be used for the sunglass sheet 15 such as a sheet of polycarbonate material, and for practical purposes the thickness of the sheet may be 0.25 mm and suitably between 0.25 mm and 0.5 mm. As shown in the drawings, the flexible tinted sheet 15 is affixed to the head band 12 by sewing its upper edge 16 to the exposed face or edge of the head band 12.

The article of headwear 10 is a baseball cap in the illustrated embodiment, but it could be a hat, cap or partial cap. In this instance the head band 12 is discontinued at the rear and replaced by adjustable connecting strips 32. The brim 13 may be of continuous annular form in the case of a full hat, but it would be preferably at the front only in the case of a cap as illustrated. The crown of the article of headwear could be partly open and need not be completely of fabric, but in the illustrated case the hat body 11 is a cup-like baseball-type cap body, having the front brim portion 14 of stiffened but flexible material. If so desired, the headband 12 could have transverse cut-away portions (not shown) beyond the end extremities 23,24 of the sunglass sheet 15 to facilitate the flexing action for movement of the sunglass sheet 15 between operative and inoperative dispositions.

It will thus be seen that the invention provides a "suncap" which is a combination of cap and blade-like lens or sunglass sheet, the latter being attached to an inside band of the cap which acts as a hinge along the sunglass sheet for the latter to be retracted back into the cap body when not required to be used. This gives the wearer the option to wear the sunglass portion of the cap in operative or "down" attitude to provide eye protection under sunny conditions, or alternatively the wearer can flip the sunglass portion of the cap back up inside the cap when conditions do not require its use.

While articles as described and illustrated will be found very effective in achieving the objects for which the invention has been devised, it will be apparent that this is illustrative only and may be subject to many modifications of constructional detail and design, without departing from the broad scope and ambit of the invention, as defined by the appended claims.

I claim:

1. An article of headwear of the type including a hat body adapted to be fitted over the scalp of a wearer and having a flexible head band to engage about the forehead and the sides of the head of a wearer, there being an affixed brim adjacent the head band and having a front brim portion for projecting forwardly in use in front of and above a wearer's eyes; in which there is secured directly to the head band beneath said front brim portion a flexible tinted sunglass sheet by a connection adapted to enable the sunglass sheet to be moved between only two wearing positions including a stored position within the hat body and an operative position extending downward below the brim and arcuately extending around a front portion of the head band in front of a wearer's eyes when the hat body is fitted over the wearer's scalp, said headband extending beyond the ends of the sunglass sheet along the hat body, and the tinted sunglass sheet is so shaped and so secured at its upper edge to the flexible head band that upon removal of the hat body, the sunglass sheet and head band may be flexed to permit the sunglass sheet to be moved flexibly in the rearwards direction from said operative position to said stored position within the hat body in which the sunglass sheet will extend upwards from the head band and be held adjacent the scalp when the hat body is re-fitted to a wearer.

2. An article of headwear according to claim 1, and further characterised in that the flexible tinted sunglass sheet is made from sheet material of uniform thickness, being of elongated form and symmetrical to each side of a middle nose-bridging portion.

3. An article of headwear according to claim 1 further characterised in that the flexible tinted sunglass sheet is formed from a cut sheet of polycarbonate material.

4. An article of headwear according to claim 1, and further characterised in that the flexible tinted sunglass sheet has a thickness between 0.25 mm and 0.5 mm.

5. An article of headwear according to claim 1 further characterised in that the flexible tinted sunglass sheet is affixed to the head band by sewing its upper edge to an exposed face or edge of the head band.

6. An article of headwear according to claim 1, and further characterised in that the hat body is in the form of a cup-like baseball-type cap body having a front stiffened but flexible brim constituting said front brim portion.

7. An article of headwear, comprising:

a hat body adapted to be fitted over the scalp of a wearer and having a flexible head band to engage about the forehead and sides of the head above the ears of a wearer;

a hat brim affixed to the hat body adjacent the head band and having a front brim portion for projecting forwardly in use in front of and above the eyes of a wearer; and a flexible transparent sunglass sheet secured directly to the head band by a connection which is adapted to enable the sunglass sheet to be moved between only two wearing positions including an extended position with said sunglass sheet extending downward from said hat brim and curved in a first direction arcuately around a front portion of the head band in front of a wearer's eyes, and a retracted position with said sunglass sheet extending upward from said hat brim into the hat body and curved in a second direction arcuately around the front portion of the head band opposite to said first direction.

8. Headwear in accordance with claim 7 in which the sunglass sheet is of tinted plastic sheet material of substantially uniform thickness.

9. Headwear in accordance with claim 8 in which the plastic sheet is made of polycarbonate.

10. Headwear in accordance with claim 7 in which the sunglass sheet is secured to the head band by sewing to form the flexible connection.

11. Headwear in accordance with claim 7 in which the hat body is in the form of a baseball-type cap body.

12. Headwear in accordance with claim 7 in which a resilient nose-contact member is attached to a lower edge of a nose-bridging portion of the sunglass sheet.

13. Headwear in accordance with claim 7 in which the sunglass sheet has downwardly curved upper edge portions at each side extremity of said sheet which are attached to the head band.

14. An article of headwear of the type including a hat body adapted to be fitted over the scalp of a wearer and having a flexible head band to engage about the forehead and the sides of the head of a wearer, there being an affixed brim adjacent the head band and having a front brim portion for projecting forwardly in use in front of and above a wearer's eyes;

in which there is secured to the head band beneath said front brim portion a flexible tinted sunglass sheet by a connection adapted to enable the sunglass sheet to be moved between a stored position within the hat body and an operative position substantially upright and arcuately extending around a front portion of the head band in front of a wearer's eyes when the hat body is fitted over the wearer's scalp;

the tinted sunglass sheet is so shaped and so secured at its upper edge to the flexible head band that upon removal of the hat body, the sunglass sheet and head band may be flexed to permit the sunglass sheet to be moved flexibly in the rearwards direction from said operative position to said stored position within the hat body in which the sunglass sheet will extend upwards from the head band and be held adjacent the scalp when the hat body is re-fitted to a wearer, said sunglass sheet being made from sheet material of uniform thickness, being of elongated form and symmetrical to each side of a middle nose-bridging portion; and in which the flexible tinted sunglass sheet has downwardly curved upper edge portions at each side extremity of said sheet attached to the head band, while said sheet has eyeglass-shaped portions with curved lower edges at each side of the nose-bridging portion.

15. An article of headwear according to claim 14, in which the flexible tinted sunglass sheet has resilient cheek-contact members fitted to the lower edges of both eyeglass-shaped portions.

16. An article of headwear according to claim 14 in which the flexible tinted sunglass sheet has a resilient nose-contact member fitted to a lower edge of the nose-bridging portion.

17. An article of headwear according to claim 16, in which the resilient nose contact member is made of foam rubber.

* * * * *